US005174687A

United States Patent [19]

Dunlop et al.

[11] Patent Number: 5,174,687

[45] Date of Patent: Dec. 29, 1992

[54] METHOD AND APPARATUS FOR INSTALLING TETHERS ON A TENSION LEG PLATFORM

[76] Inventors: David N. Dunlop; Pieter G. Wybro, both of One Park Ten Pl., Suite 350, Houston, Tex. 77084

[21] Appl. No.: 835,543

[22] Filed: Feb. 14, 1992

[51] Int. Cl.[5] ..... E02D 5/74; B63B 21/50

[52] U.S. Cl. ..... 405/223.1; 405/195.1; 405/224

[58] Field of Search ..... 405/195.1, 224, 225, 405/227, 223.1, 224.2-224.4; 114/265, 264, 294; 175/5-7; 166/350, 359, 367

[56] References Cited

U.S. PATENT DOCUMENTS

| | | | |
|---|---|---|---|
| 4,784,529 | 11/1988 | Hunter | 405/224 X |
| 4,844,659 | 7/1989 | Hunter et al. | 405/195.1 X |
| 4,848,970 | 7/1989 | Hunter et al. | 405/224 |
| 4,913,592 | 4/1990 | Petty et al. | 405/223.1 |
| 4,934,870 | 6/1990 | Petty et al. | 405/223.1 |

*Primary Examiner*—Dennis L. Taylor
*Attorney, Agent, or Firm*—Kenneth A. Roddy

[57] ABSTRACT

A method and apparatus for installing and tensioning mooring tethers or tendons between a subsea foundation and a tension leg platform. Load bearing porch members secured on the platform columns near the hull receive the threaded upper end of tethers which are engaged at their lower ends in the foundation. Movable hoists on the platform deck position the upper ends of the tethers on the porches. A platform arrester through which the hoist lines pass is connected with each hoist to move with the platform during vertical motions thereof and selectively engage the hoist lines to allow only downward movement of the platform arrester relative to the hoist lines. A motorized tether tensioning tool connected to each hoist line has a lock-down nut at its lower which releasably connects to the upper end of each tether such that the nut is vertically movable on the tether. The upper ends of the tethers are positioned on the porches and nominal constant tension is applied to the tethers while the platform arresters allow only downward movement relative to the hoist line until platform trim is within predetermined limits. The tensioning tools then run the nuts down on the tethers to engage them on the porches and apply tension in the tethers between the porches and foundation and are thereafter removed whereby tension loading in each tether is transmitted to the platform such that the total platforn tension load is equally distributed between the whole tether complement.

20 Claims, 4 Drawing Sheets

METHOD AND APPARATUS FOR INSTALLING TETHERS ON A TENSION LEG PLATFORM

BACKGROUND OF THE INVENTION

1. Field of the Invention

This invention relates generally to tension leg platforms, and more particularly to tether or tendon installation and tensioning systems for tension leg platforms.

2. Brief Description of the Prior Art

In the offshore oil and gas industry, a tension leg platform or "TLP" is often used in deepwater production activities. The tension leg platform has a buoyant hull which supports a work deck from which the drilling and production operations are conducted. The platform hull is moored to a foundation on the ocean floor by a set of elongate tethers or tendons which extend from the foundation and are secured to the buoyant hull under tension. The tethers or tendons are kept in tension by the buoyancy of the platform hull and maintain the hull at a significantly greater draft than if it were free floating. Tidal motion and wave action are compensated for by lateral movement of the platform and tethers. Vertical movements, normally associated with heave, pitch and roll motions of the sea are eliminated by the combined buoyancy of the platform and tethers.

One of the problem areas in conventional tension leg platform design and operation is the system for installing and tensioning of the tethers. In many conventional TLP systems, the tethers are installed by lowering them to the ocean floor through columns on the platform hull. To accomplish the installation, the tethers are made up of threaded tubular segments which are secured together section by section as the tether is lowered. This method is time consuming and increases the vulnerability of the platform to adverse weather conditions during the installation process.

Because of the expense involved in providing costly tensioning equipment for each tendon being worked on, the normal practice in prior art tension leg platform installation methods is to "lock-off" on a single tether (tendon) per platform corner. However, this practice often causes large stresses in the tethers (tendons) resulting from resonant vertical oscillations of the platform which may occur when it is only partially secured.

There are several patents which disclose various tether installation apparatus and methods.

Hunter, U.S. Pat. No. 4,320,993 discloses a connector apparatus for connecting a tension leg platform mooring tether to a subsea foundation. The apparatus comprises a plug positioned on the lower end of the mooring tether for mating with a receptacle positioned in the foundation so that the plug is positioned in the receptacle to maintain the mooring tether in connection with the foundation with the plug being removable from the receptacle when desired.

Collipp, U.S. Pat. No. 4,620,820 discloses a method an apparatus for anchoring a tension leg platform using an anchor having an upper and lower assembly. The upper assembly is operatively connected to the lower ends of the tethers forming the tension legs of the platform and acts to space and align each tether in a vertical manner when the upper assembly is connected to the lower assembly which has been previously secured to the ocean floor by anchor piles.

Gunderson, U.S. Pat. No. 4,881,852 discloses a system for securing and tensioning the tethers of a tension leg platform. The top ends of the tethers are positioned a distance below the bottom of the platform hull and a removable tensioning tool is situated within the hull for lowering a tether extender to each tether and then biasing each tether and tether extender unit upward to tension the tether.

Peppel, U.S. Pat. No. 4,943,188 discloses a rotating lug anchor connector for anchoring the tether of a tension leg platform to the sea floor. The connector includes a latch assembly mounted on the lower end of the tether having lugs which are slidably received in slots in a foundation receptacle and engaged on notches in the foundation receptacle upon upward movement. The tether is released by lowering it and moving the lugs into alignment with the slots.

The present invention is distinguished over the prior art in general, and these patents in particular by a method and apparatus for installing and tensioning mooring tethers or tendons between a subsea foundation and a tension leg platform. Load bearing porch members secured on the platform columns near the hull receive the threaded upper end of tethers which are engaged at their lower ends in the foundation. Movable hoists on the platform deck position the upper ends of the tethers on the porches. A platform arrester through which the hoist lines pass is connected with each hoist to move with the platform during vertical motions thereof and selectively engage the hoist lines to allow only downward movement of the platform arrester relative to the hoist lines. A motorized tether tensioning tool connected to each hoist line has a lock-down nut at its lower which releasably connects to the upper end of each tether such that the nut is vertically movable on the tether. The upper ends of the tethers are positioned on the porches and nominal constant tension is applied to the tethers while the platform arresters allow only downward movement relative to the hoist line until platform trim is within predetermined limits. The tensioning tools then run the nuts down on the tethers to engage them on the porches and apply tension in the tethers between the porches and foundation and are thereafter removed whereby tension loading in each tether is transmitted to the platform such that the total platform tension load is equally distributed between the whole tether complement.

SUMMARY OF THE INVENTION

It is therefore an object of the present invention to provide a tether installation method and apparatus for tension leg platforms which will allow lock-off of the hull directly to the tethers (tendons) without requiring hydraulic tensioning jacks or similar devices.

It is another object of the present invention to provide a tether installation method and apparatus for tension leg platforms which will allow lock-off of the platform to all tethers (tendons) simultaneously resulting in reduced stress in the tethers (tendon) caused by resonant vertical oscillations.

Another object of the present invention to provide a tether installation method and apparatus for tension leg platforms which will allow the tethers to be quickly installed and connected and significantly reduce the vulnerability of the hull to adverse sea and weather conditions in the transitional phase during installation from the free-riding, unrestrained floating condition to the condition where the tethers have been locked-off and the vertical hull motions are restrained.

Another object of this invention to provide a tether installation method and apparatus for tension leg platforms in which the locking-off procedure will insure that the tension loads in the tethers are uniform within a relatively limited tolerance.

Another object of this invention is to provide a tether installation method and apparatus for tension leg platforms which will minimize equipment costs and overall installation costs.

Another object of this invention is to provide a tether installation method and apparatus for tension leg platforms which will eliminate the need for providing, installing, and removing, temporary buoyancy units and the costs associated with tether pre-installation.

Another object of this invention is to provide a tether installation method and apparatus for tension leg platforms which will eliminate the problem of a platform "float over", and its station-keeping control and mooring connection difficulties.

A further object of this invention is to provide a tether installation method for tension leg platforms which will significantly reduce the risk of mooring line/tether entanglement.

A still further object of this invention is to provide a tether installation method for tension leg platforms which is simple in operation and quickly finished.

Other objects of the invention will become apparent from time to time throughout the specification and claims as hereinafter related.

The above noted objects and other objects of the invention are accomplished by the present method and apparatus for installing and tensioning mooring tethers or tendons between a subsea foundation and a tension leg platform. Load bearing porch members secured on the platform columns near the hull receive the threaded upper end of tethers which are engaged at their lower ends in the foundation. Movable hoists on the platform deck position the upper ends of the tethers on the porches. A platform arrester through which the hoist lines pass is connected with each hoist to move with the platform during vertical motions thereof and selectively engage the hoist lines to allow only downward movement of the platform arrester relative to the hoist lines. A motorized tether tensioning tool connected to each hoist line has a lock-down nut at its lower which releasably connects to the upper end of each tether such that the nut is vertically movable on the tether. The upper ends of the tethers are positioned on the porches and nominal constant tension is applied to the tethers while the platform arresters allow only downward movement relative to the hoist line until platform trim is within predetermined limits. The tensioning tools then run the nuts down on the tethers to engage them on the porches and apply tension in the tethers between the porches and foundation and are thereafter removed whereby tension loading in each tether is transmitted to the platform such that the total platform tension load is equally distributed between the whole tether complement.

DESCRIPTION OF THE PREFERRED EMBODIMENT

Figures 1, 2, 3:
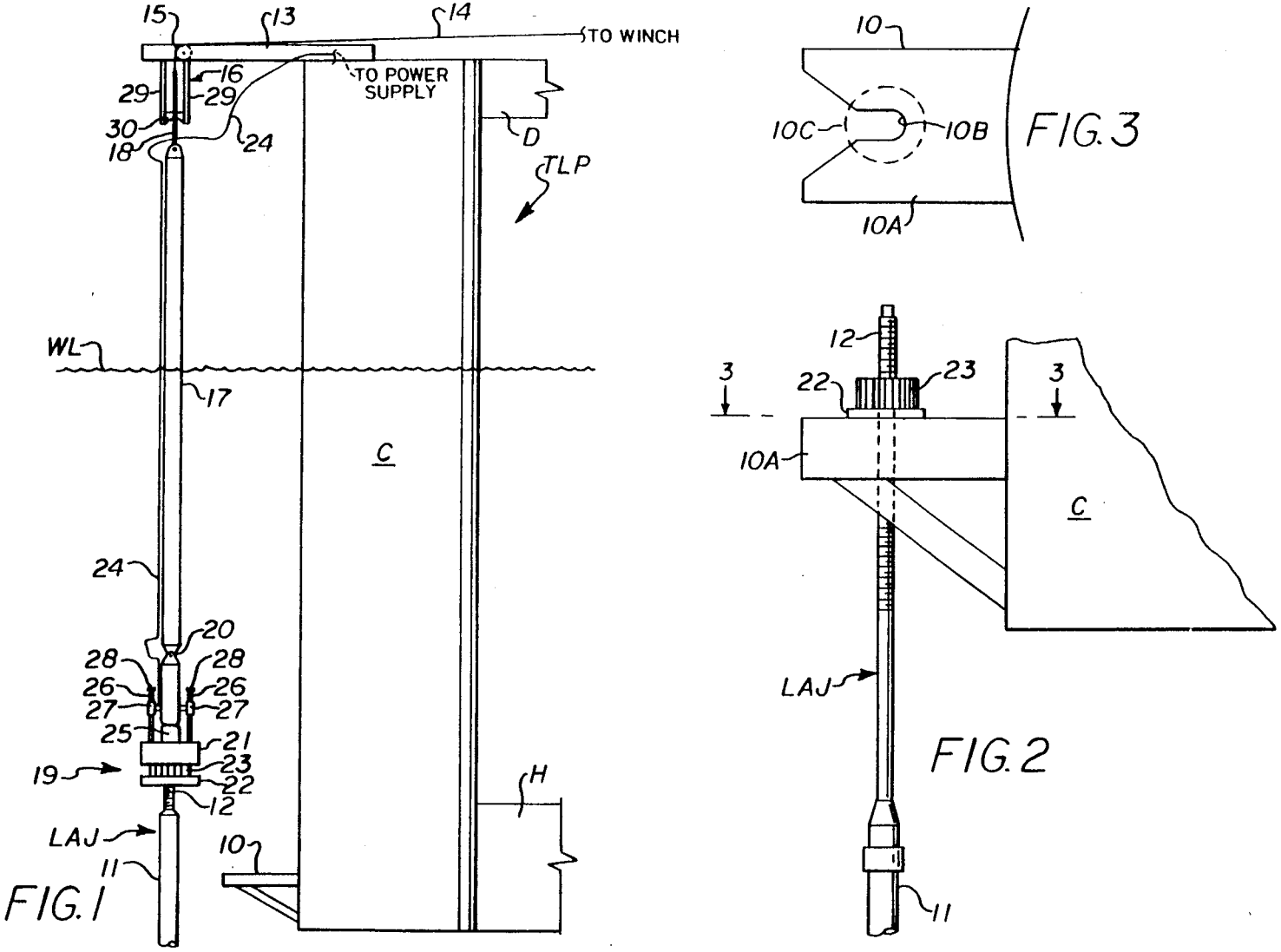
FIG. 1 is an elevation view of one side of a tension leg platform showing the tether installation apparatus in accordance with the present invention.
FIG. 2 is an elevation of a porch secured to the hull showing the upper end of a tether engaged therein.
FIG. 3 is a top plan view of the hull porch taken along line 3—3 of FIG. 2 with the upper end of the tether connection shown in dotted line.

Referring to the drawings by numerals of reference, there is shown in FIGS. 1 through 5, apparatus used in the present method of installing tethers on tension leg platforms. The tension leg platform TLP has a buoyant hull H which supports a work deck D from which the drilling and production operations are conducted. The deck D is supported on columns C secured vertically between the deck and hull H. A hull/tether connection or "porch" 10 is secured to the exterior of the corner columns C near the bottom of the hull and has a horizontal load bearing member 10A which extends outwardly from the column. As seen in FIG. 3, the load bearing member 10A of the porch 10 has an aperture 10B with an outwardly extending slot 10C which receives the upper end of the tether or tendon 11, as explained hereinafter.

The tethers or tendons 11 which are used in the present installation method have an upper section, referred to as the "length adjustment joint" LAJ, having an externally threaded top section 12 which is received in the slot 10C of the porch 10. As described hereinafter, a lock nut 22 is received on the threaded top section 12 of the length adjustment joint LAJ and is seated on the upper surface of the load bearing member 10A of the porch 10. The load bearing member 10A may also be provided with a flexible bearing (conventional and not shown) to allow a degree of rotational freedom of the tether (tendon) with respect to the porch.

The length adjustment joint LAJ allows adjustment of the final effective length of each of the tethers (tendons) such that the total platform tension load is equally distributed between the whole tether (tendon) complement. Tension loading in the tether (tendon), via the contact interface between the lock nut 22 and porch 10, is transmitted to the platform.

A hoist system on the deck D has a cantilever support structure 13 which extends outwardly from the top of the column above the porch 10. A hoist line 14 connected to a winch (not shown) is suspended from a mobile head sheave 15 mounted on the cantilever support structure 13. The winch must have constant-tension capability in order to pull the tether up to engage the foundation connection while the platform is subject to motion responses. The sheave 15 may be fixed or horizontally movable such that the tether 11 may be "parked and secured" outboard and then be retracted inboard to dock into the porch (described hereinafter). Preferably, the hoist support structure 13 is mounted on a dolly or sledge with provisions for fixing in the two operating locations.

A platform arrester 16 (described hereinafter) is also suspended from the cantilever support structure 13. The platform arrester support structure may alternatively be located at any convenient height between the waterline and the top of the column.

A tether extension 17 is hingedly connected at its upper end to the hoist line 14 by a wire-rope sling 18 and has a motorized lock-nut assembly 19 at its lower end which is received on the threaded top end 12 of the tether 11. The tether extension 17 is a tubular member which extends approximately 15 meters below the platform deck D to compensate for the considerable distance between the hull bottom and the deck level. To facilitate tether installation, the tether extension 17 may be hinged intermediate to its top and bottom ends as indicated at 20. This requirement depends upon the handling capabilities of the installation vessel utilized. The hoist system is capable of raising the tether top approximately 15 meters above the porch level.

The wire-rope sling 18 is approximately 15 meters long and connects the top end of the tether extension 17 to the hoist line 14 and has socket terminations at each end to minimize elasticity under loading. The wire-rope sling 18 is constructed of material having sufficient cross sectional area and elongation characteristics for suspending the tether and tether extension assembly, pre-tensioning the tether loadings, and to arrest vertical movement of the platform sufficiently to permit lock-off operations. Since the wire-rope is not required to bend, there are no strength losses and "low elasticity" type wire rope may be employed.

Figure 4:
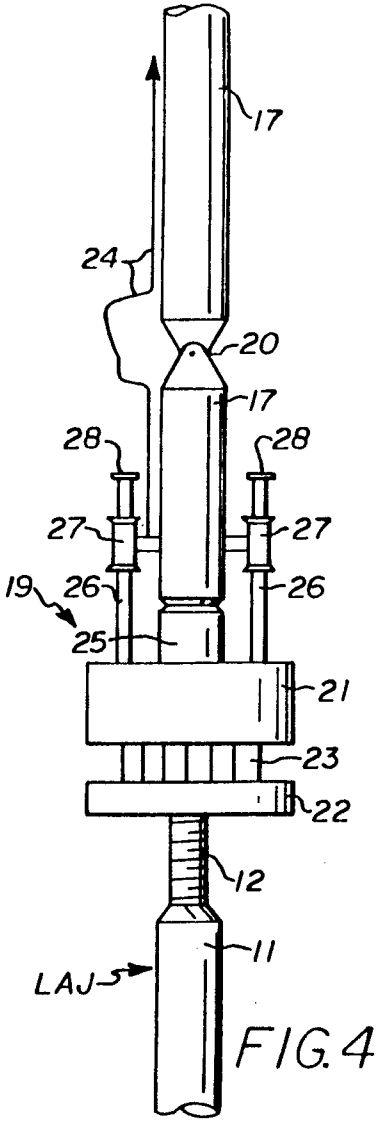
FIG. 4 is an elevation of the lock nut assembly of the present invention.

As best seen in FIG. 4, the lock-nut assembly 19 comprises a frame having a cylindrical housing 21 which contains one or more hydraulic or pneumatic motors (not shown) which are operatively connected to a rotatable nut 22 journalled on bearings in the housing and having exterior splines 23 and interior threads. The nut 22 is rotated with a nominal applied torque by the motor(s) via engagement of the splines 23 with the motor drive gear. The nut 22 is threadedly received on the threaded top end 12 of the tether 11 and the lock-nut assembly substantially encloses and protects the threaded top end of the tether. The lock-nut power umbilical lines 24 extend up to the deck via the tether suspension system. By power circuit reversal the nut 22 may be driven both up and down on the threaded top end of the tether length adjustment joint LAJ.

A tubular connector 25 extends upwardly from the top of the lock-nut housing 21 and a pair of smaller diameter tubular guide posts 26 extend vertically upwardly from the top of the housing laterally outwardly of the connector 25. The guide posts 26 are slidably received through tubular guides 27 secured to the lower portion of the tether extension 17 and are provided with stop flanges 28 at their upper ends. The lock-nut assembly 19 can travel a vertical distance relative to the lower end of the tether extension 17 controlled by the stop flanges 28 and cylindrical housing 21.

Figure 5:
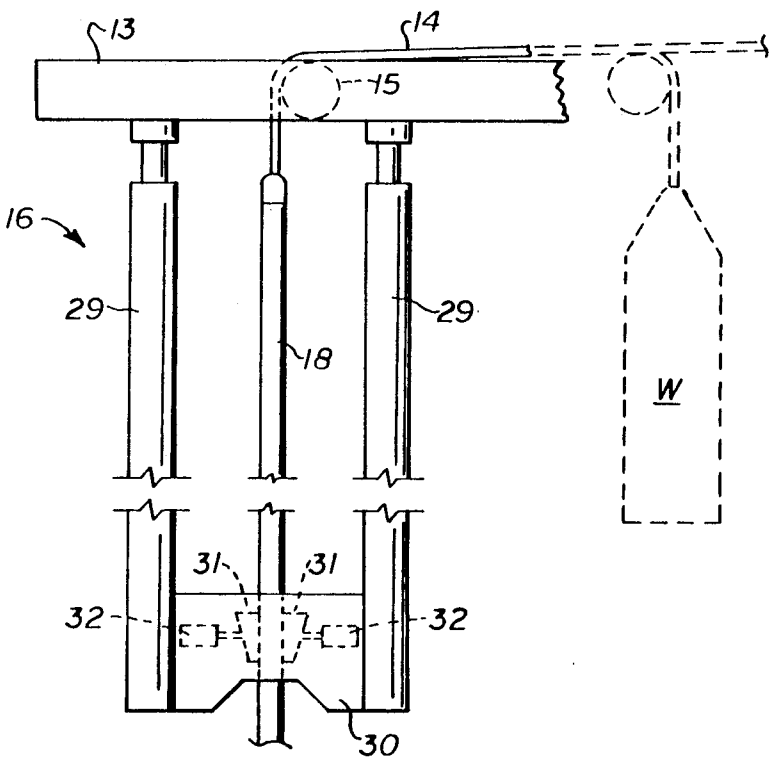
FIG. 5 is an elevation of the platform arrester assembly of the present invention.

As best seen in FIG. 5, the platform arrester 16 is rigidly suspended from the hoist cantilever support frame 13. The platform arrester 16 has a pair of telescoping elongate tubular hangers 29 connected at their top ends to the bottom of the support frame 13 and a slip bowl 30 secured between the hangers at their bottom ends. A set of slips 31 are movably mounted in the slip bowl 30. The wire-rope 18 is slidably received through the slips 31. The slips 31 are operatively connected to actuating springs and hydraulic retract rams 32 such that once released, the slips engage on the wire-rope impeding its downward movement. As the platform arrester 16 moves downward with the platform movement, the controlled tension hoist line 14 maintains nominal tension in the tether and hoist system, and allows free downward movement of the hull.

The slips 31 in the biased locking position upon downward movement of the platform arrester allow only downward movement relative to the hoist line until no further relative movement between the platform arrester and the hoist line occurs and movement between the upper end of the tether (tendon) and the porch 10 has been dampened.

Depending upon the deck layout and available space, one hoist system may be utilized to handle more than a single tether. If each tether (tendon) does not have a dedicated winch, nominal constant tension on each individual tether assembly may be simply and economically accomplished by load transfer to a "clumpweight after the bottom foundation connections are engaged.

As illustrated schematically by dotted line in FIG. 5, the clumpweight W is a weight which is connected to the hoist system line and when suspended, provides a constant, motion-compensated applied load to the hoist system and, in turn, an applied tension to the tether (tendon). The clumpweight may be freely suspended from the hoist line or secured by guide rails attached to the platform column. The clumpweight provides total reliability, since there are no machinery components.

OPERATION

Having described the major components of the tether installation apparatus, a description of the method of installing the tethers follows with reference to FIGS. 6 through 9. The following description outlines the procedures for connecting the tethers 11 to pre-installed foundations F on the ocean floor and to the porches 10 on the hull H and for securing the tension leg platform at operating draft with tether tensions equalized. It should be understood that site and project specific criteria will possibly modify these procedures somewhat. The bottom ends of the tethers 11 and the foundations F which are anchored on the ocean floor are of conventional construction and are therefore not shown in detail.

Figure 6:
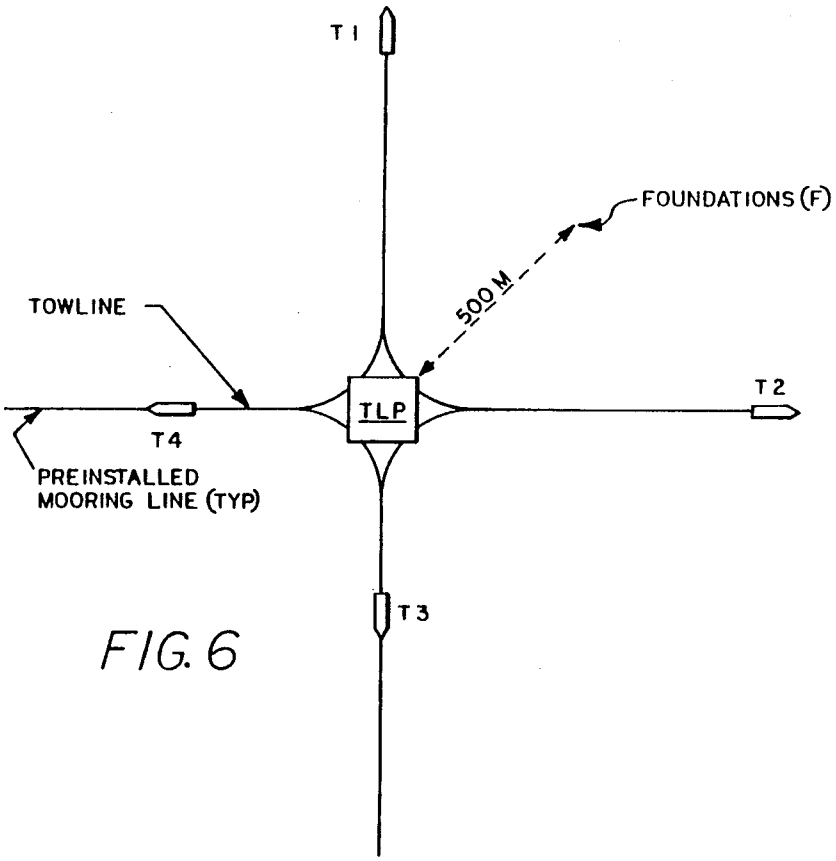
FIG. 6 is a schematic top plan view of the initial platform mooring arrangement.

Referring now to FIG. 6, a fixed mooring system is required in order to adequately station and maintain the platform over the foundations F and perform position changes in order to connect the tether. On arrival at the site, four tow tugs T1–T4 are connected to pre-installed mooring legs. Adjusting respective towline lengths, the platform TLP is maneuvered to a "stand-off" location approximately 500 meters from the subsea foundations F.

Figure 7:
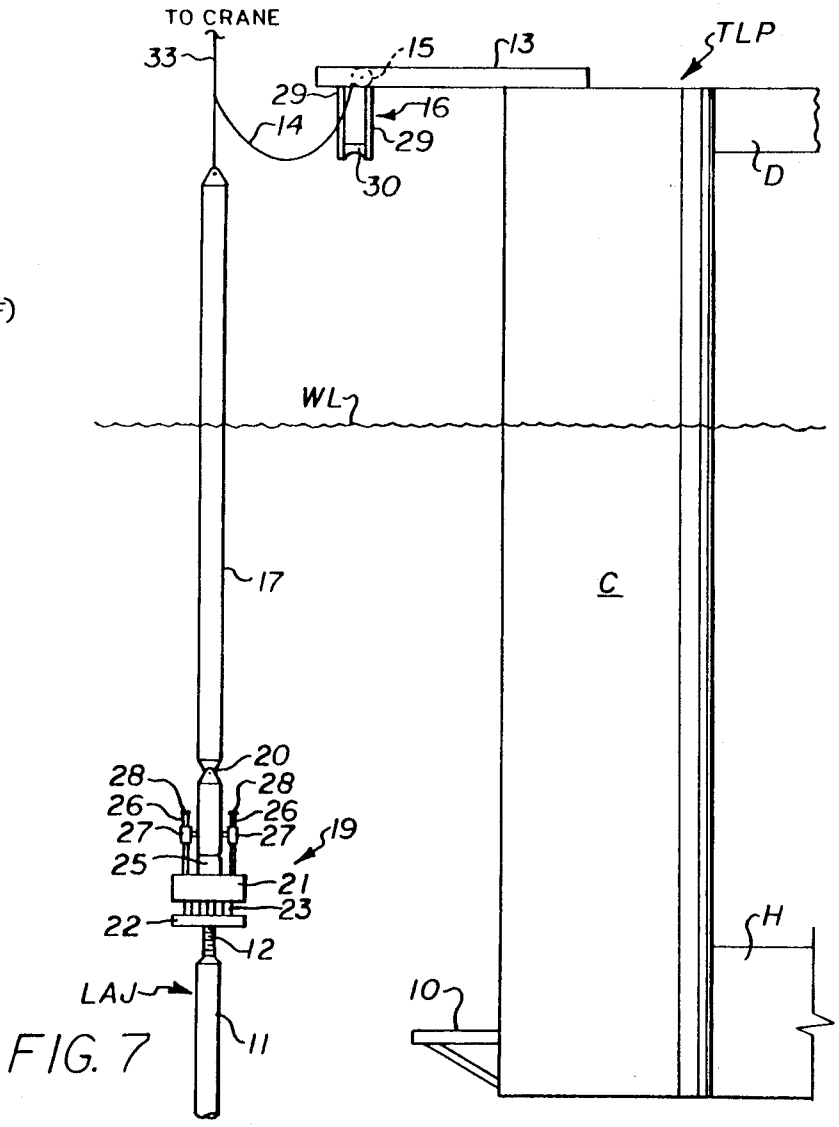
FIG. 7 is an elevation of the upended tether being passed over from the crane vessel to the platform in the installation of the tethers.

The installation vessel prepares the complete tether, lock-nut, and tether extension assembly. As shown in FIG. 7, the vessel maneuvers close to a corner of the platform and the platform hoist line 14 is transferred to the vessel and connected to the top end of the tether extension 17. The hoist line 14 is connected to a vessel crane hoist line 33.

Figure 8:
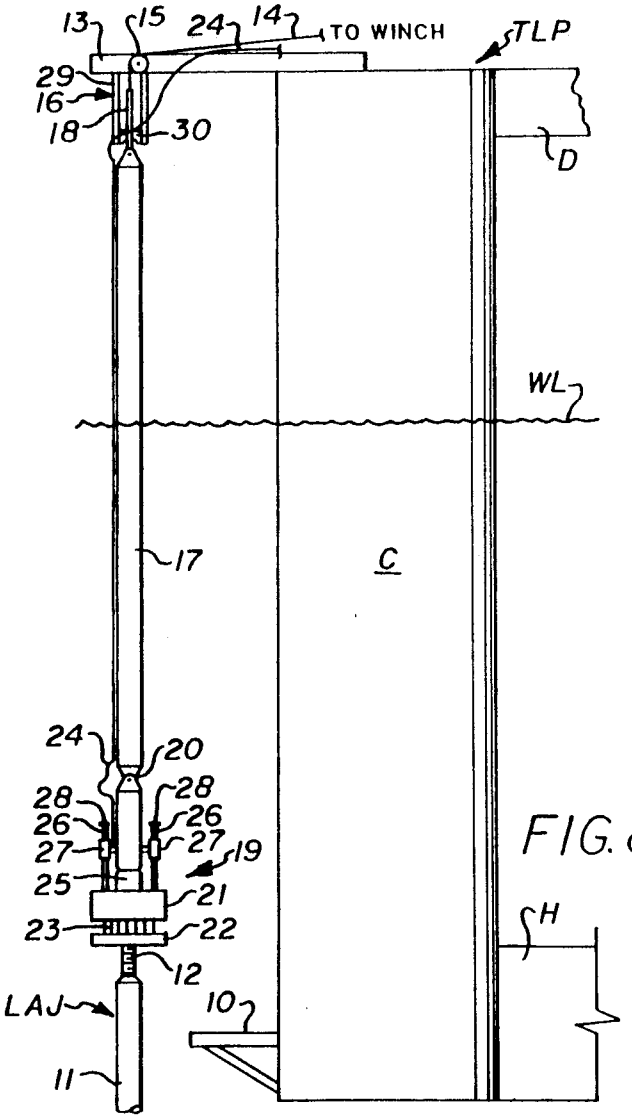
FIG. 8 is an elevation of a tether being passed in an upright position prepared for installation.

As shown in FIG. 8, the tether 11 is then lifted by the vessel crane over to the platform and the payload is transferred to the platform hoist. The tether 11 is raised to a "standby" elevation, secured to the wire-rope sling 18 extending through the platform arrester 16 and the vessel crane hoist line 33 is de-rigged and released. Preliminary design studies of the suspended tether motion response in a summer storm, indicate that the tethers must be 4 to 5 meters from the porches and each other to avoid damages.

The lock-nut assembly umbilical line 24 is connected to the power supply and final function tests are executed to verify that the equipment is ready for installation. The bottom of the tether 11 is then rigged for pull-in. All the tethers 11 are transferred and secured on the platform in the foregoing manner. At this stage the installation vessel is demobilized from the field, and the platform awaits an acceptable sea state to proceed with tether connection operations. In the event of adverse prevailing or forecast sea or weather conditions exceeding the capacity of the mooring system, the mooring tugs abandon the moorings and take the platform under tow.

Figure 9:
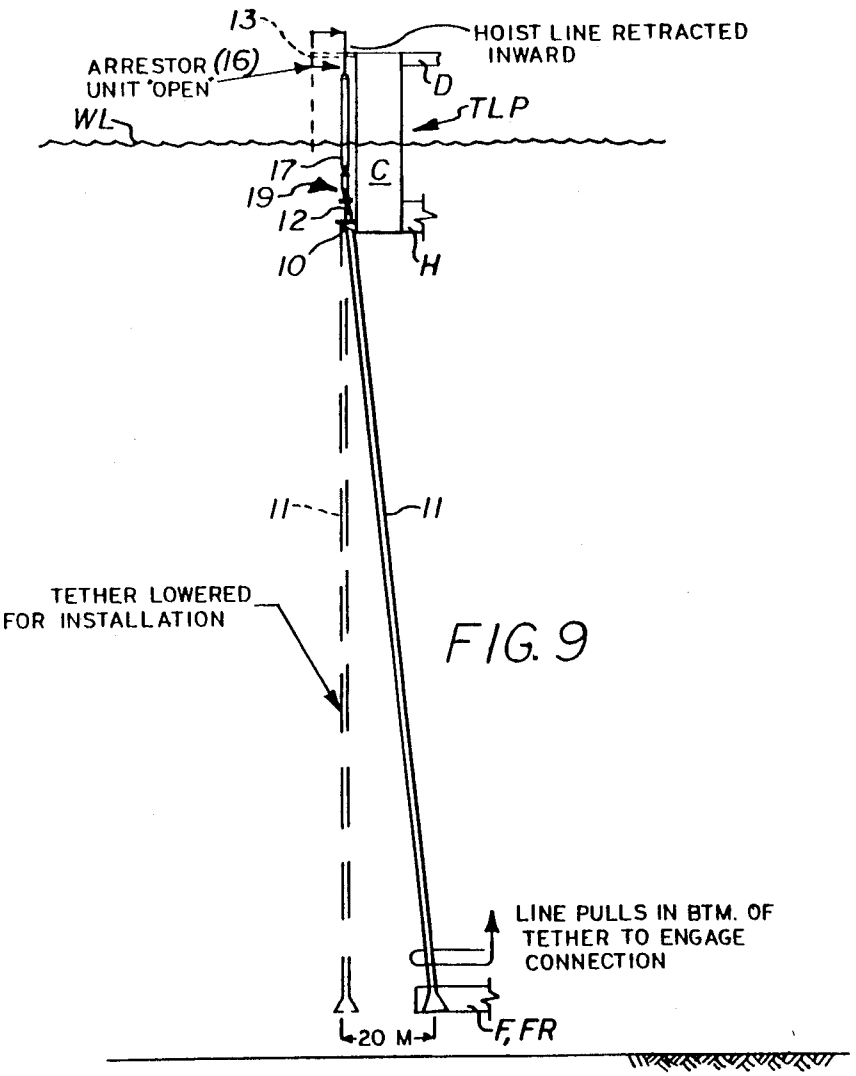
FIG. 9 is an elevation of a tether being engaged at its lower end into a foundation receptacle.

With acceptable prevailing and forecast conditions, the platform TLP is maneuvered to a position approximately 20 meters offset from final position, along a diagonal from the column position (FIG. 9). The hoist lines 14 of the tethers (in one corner) are lowered then retracted inward to engage the upper ends of the tethers into their respective mooring porches 10.

Each tether (tendon) is then lowered to installation elevation and the bottom of the tether is pulled in to engage into the foundation receptacle FR. All tethers on one platform corner are connected to the foundations in this manner.

The platform is then maneuvered to each corner sequentially and the tethers at the other corners are engaged into the respective foundation receptacles. The platform is now positioned directly over the foundations.

Once the platform position is confirmed to be correct, simultaneously on all tethers, the intermediate platform arrest operation is performed. At this stage all of the tethers are in constant nominal tension. The mean trim of the platform hull is verified to be horizontal and the slips in the platform arresters are released. Automatically accompanying the dynamic vertical motions of the platform, the arresters 16 travel down on the wire-rope slings 18. The slips 31 in the biased locking position upon downward movement of the platform arresters allow only downward movement relative to the wire-rope slings 18. This self-arresting phase is allowed to continue over a period of time until no further relative movement between arresters and wire-rope slings is observed and movement between the upper end of the tethers (tendons) and the porches 10 has been dampened. Thus, after a period of time, the hull will self-stabilize at a new increased draft and cease to respond vertically to the action of the waves.

Once it has been verified that the tether/porch movement has been dampened to within prescribed limits, the platform trim acceptability is again verified. If adjustment is required, the trim may be corrected by ballasting the high corner of the hull. As the hull descends, the slips in the arresters at the descending corner self-actuate again to re-secure the platform at the desired trim.

Referring again to FIG. 2, with the platform trim accepted, the lock-nut assemblies 19 are actuated to run down on the top end of the tethers and lock-off on the porches 10. Depending on power capacity it is optional to run corner groups of nuts individually or simultaneously. For deepwater locations and/or large displacement platforms, it is desirable to lock-off simultaneously on as many tethers (tendons) as possible. The platform arrester units 16 are then released by de-tensioning the arrester support hangers 29. The hull is then de-ballasted to the final predetermined in-service configuration.

While this invention has been described fully and completely with special emphasis upon a preferred embodiment, it should be understood that within the scope of the appended claims the invention may be practiced otherwise than as specifically described herein.

We claim:

1. Apparatus for installing and tensioning mooring tethers between a subsea foundation and a tension leg platform of the type having a work deck supported on columns above a buoyant hull, the apparatus comprising;

tether support means on the platform columns near the hull, a plurality of elongate mooring tethers each having a lower end adapted to be secured to the subsea foundation and an upper end adapted to be connected to a hoist line and to be received and secured on said tether support means, hoist means having a cantilever support structure movably mounted on the work deck near each column above said tether support means and including a sheave and a hoist line supported on said sheave and connected to a winch, said hoist means being horizontally movable to move said sheave inwardly and outwardly relative to said tether support means, and tether connection means having an upper end adapted for connection to said hoist line and a lower end adapted to releasably engage the upper end of said tether for supporting and lifting said tether and including tensioning means for applying tension in said tether, said tether connection means being engaged at its lower end on said tether upper end and connected at its upper end to said hoist line and said tether being maneuvered by said hoist means into position on said tether support means and secured at its lower end to said foundation and said tether connection tensioning means being activated to secure said tether to said tether support and apply tension in said tether between its connection in said tether support means and the foundation and thereafter said tether connection means being removed from said tether, whereby tension loading in each said tether is transmitted to the platform by the engagement of said tethers on said tether support means.

2. Apparatus according to claim 1 including;

platform arrester means operatively connected with said cantilever support structure including slip means through which said hoist line slidably passes and said slip means being selectively moveable between a retracted position allowing said hoist line to slide therethrough and a biased locking position engaged with said hoist line to allow only downward movement of said platform arrester relative to said hoist line, whereby prior to said tether being secured to said tether support means, said platform arrester moves with said platform during dynamic vertical motions of the platform while said hoist means maintains constant nominal tension on said tether and said hoist line, and said slips in the biased locking position upon downward movement of said platform arrester allow only downward movement relative to said hoist line until relative movement between said platform arrester and said hoist line and movement between said tether upper end and said tether support means has been dampened and platform trim is within predetermined limits.

3. Apparatus according to claim 1 including;

an elongate sling connected at its upper end to said hoist line and at its lower end to the upper end of said tether connection means for suspending and supporting said tether and said tether connection means, said sling formed of material having sufficient strength to arrest vertical movement of the platform to permit lock-off operations and having cross sectional area and elongation characteristics to minimize elasticity under tension loads.

4. Apparatus according to claim 3 in which said sling is formed of low elasticity wire rope.

5. Apparatus according to claim 1 in which;

said hoist means winch has constant tension capability to apply a nominal, motion-compensated, constant tension load on said tethers via said hoist line after they have been secured in the foundations and their upper ends have been received on said tether support means.

6. Apparatus according to claim 1 including;

weight means operatively connected to the upper end of said tethers to apply a nominal, motion-compensated, constant tension load on said tethers after they have been secured in the foundations and their upper ends have been received on said tether support means.

7. Apparatus according to claim 5 wherein;

said weight means comprises one or more clumpweights operatively connected to said hoist line which is connected to the upper end of said tethers and selectively supported by said sheave, such that when supported, said clumpweights apply a constant, motion-compensated load to said hoist line.

8. Apparatus according to claim 1 wherein;

said tether connection means comprises a tubular extension member hingedly connected at its upper end to said hoist line and having a lower end adapted to releasably engage the upper end of said tether for supporting and lifting said tether and including tensioning means for applying tension in said tether.

9. Apparatus according to claim 8 wherein;

said tubular extension member is hinged intermediate to its top and bottom ends to facilitate engagement of its lower end on said tether upper end.

10. Apparatus according to claim 1 wherein;

said tether support means has a load bearing horizontal support surface extending outwardly from said platform columns near the hull, said tether connection means lower end has a motorized connector operatively connected to a power source on the platform deck to be received on the upper end of said tether, said motorized connector being operative to selectively engage the upper end of said tether for supporting and lifting said tether and to move vertically thereon and to engage said horizontal support member for applying tension in said tether, such that tension loading in said tether between said motorized connector engagement with said horizontal support surface and the foundation is transmitted to the platform.

11. Apparatus according to claim 10 wherein;

the upper end of each said tether is threaded.

said motorized connector comprises a motor operatively and releasably connected to a threaded nut to rotate said nut for moving it vertically on the threaded upper end of said tether, said horizontal support is apertured to receive the threaded upper end of said tether, and said nut is configured to engage said horizontal support surface and thereafter continued rotation thereof applying an upward force on said tether to create tension in said tether which is transmitted to the platform and thereafter said motor is removed from said nut, whereby said nut allows adjustment of the final effective length of each of the tethers such that the total platform tension load is equally distributed between the whole tether complement.

12. Tension leg platform arrester apparatus for restraining the vertical motion of a tension leg platform during installation and tensioning of mooring tethers between a subsea foundation and the tension leg platform, the platform having a work deck supported on columns above a buoyant hull and a hoist system including support structure and a hoist line connected to a winch, the arrester apparatus comprising;

a platform arrester housing connected with the hoist support structure to move with the support structure and platform during dynamic vertical motions of the platform, slip means movably mounted in said housing through which the hoist line slidably passes, actuating means operatively connected with said slip means for selectively moving said slip means between a retracted position allowing the hoist line to slide therethrough and a biased locking position engaged with the hoist line to allow only downward movement of said platform arrester relative to the hoist line, such that when the tether is secured at its lower end in the foundation and connected at its upper end to the hoist line and constant tension is applied thereto through the hoist line, said platform arrester moves with the platform during dynamic vertical motions of the platform, and when said slips are actuated to the biased locking position said platform arrester will allow only downward movement of the support structure and platform relative to the hoist line and restrict upward movement thereof until relative movement of between the platform and the hoist line is diminished and platform trim is within predetermined limits.

13. Tension leg platform arrester apparatus according to claim 12 including;

an elongate sling connected at its upper end to the hoist line and at its lower end to the upper end of the tether for suspending and supporting said tether, said sling forming the portion of the hoist line which slidably passes through said slip means and is selectively engaged thereby, and said sling formed of material having sufficient strength to arrest vertical movement of the platform to permit lock-off operations and having cross sectional area and elongation characteristics to minimize elasticity under tension loads.

14. Tension leg platform arrester apparatus according to claim 13 in which said sling is formed of low elasticity wire rope.

15. Tension leg platform arrester apparatus according to claim 12 including weight means operatively connected to the hoist line which is connected to the upper end of the tethers, said weight means being selectively suspended on said hoist line to apply a nominal, motion-compensated, constant tension load on the tethers through the hoist line while said platform arrester moves with the platform during dynamic vertical motions of the platform.

16. A method of installing and tensioning mooring tethers between a subsea foundation and a tension leg platform at an offshore location above a subsea foundation on the ocean floor comprising the steps of:

positioning a tension leg platform hull above said foundation;

said tension leg platform having a work deck supported on columns above a buoyant hull, outwardly extending tether support members secured on the columns near the hull, hoist means on the platform deck near each column which are extensible outwardly from the work deck above each said tether support member, and platform arrester means operatively connected with each said hoist means through which a hoist line passes, said platform arrester means moving with said platform during vertical motions thereof and selectively operable to engage said hoist line for allowing only downward movement of said platform arrester means relative to said hoist line, securing the upper end of a tether tensioning tool having a tether connector at its lower end to each said hoist line and connecting each said tensioning tool to the upper end of a plurality of tethers, each said tether connector being vertically movable on each said tether for engaging said tether support member;

positioning the upper ends of said tethers on said tether support members and engaging their lower ends in the foundation;

applying and maintaining tension in said plurality of tethers; and while maintaining constant tension in said tethers actuating said platform arrester means to allow only downward movement relative to said hoist line until no further relative movement between said platform arrester means and said hoist line is observed and movement between the upper ends of said tethers and said tether support members has been dampened and platform trim is within predetermined limits; and upon determination that platform trim is within predetermined limits, activating said tether tensioning tools and said tether connectors to engage said tether support member and apply tension in said tether between its connection in said tether support member and the foundation; and thereafter removing said tether tensioning tools from said tethers and deballasting the platform hull to a predetermined in-service trim, whereby tension loading in each said tether is transmitted to the platform by the engagement of said tether connectors on said tether support members such that the total platform tension load is equally distributed between the whole tether complement.

17. The method according to claim 16 wherein:

upon determination that trim adjustment is required;

ballasting the high corner of the hull to correct the trim; and actuating said platform arresters at the descending corner of the hull to allow only downward movement until the platform is secured at the proper trim, and activating said tether tensioning tools and said tether connectors at the descending corner of the hull to engage said tether support member and apply tension in said tether between its connection in said tether support member and the foundation; and thereafter removing said tether tensioning tools from said tethers and deballasting the platform hull to a predetermined in-service trim, whereby tension loading in each said tether is transmitted to the platform by the engagement of said tether connectors on said tether support members such that the total platform tension load is equally distributed between the whole tether complement.

18. A method for restraining the vertical motion of a tension leg platform during installation and tensioning of mooring tethers between a subsea foundation and the tension leg platform, the platform having a work deck supported on columns above a buoyant hull and a hoist system including support structure and a hoist line connected to a winch, comprising the steps of;

securing a platform arrester apparatus to the hoist support structure to move with the support structure and platform during dynamic vertical motions of the platform, said platform arrester having a housing with slip means movably mounted therein and actuating means operatively connected with said slip means for selectively moving said slip means between a retracted position allowing a hoist line to slide therethrough and a biased locking position engaged with the hoist line to allow only downward movement of said platform arrester relative to the hoist line;

passing the free end of the hoist line through said slip means and connecting it to the upper end of a tether secured at its lower end to the foundation;

applying constant tension to the tether through the hoist line;

while applying constant tension, actuating said slip means to the biased locking position engaged with the hoist line to allow only downward movement of said platform arrester relative to the hoist line, whereby said platform arrester will allow only downward movement of the support structure and platform relative to the hoist line and restrict upward movement thereof until relative movement of between the platform and the hoist line is diminished and platform trim is within predetermined limits.

19. The method according to claim 18 including the step of;

prior to passing the hoist line through said slip means, connecting the upper end of an elongate sling to the free end of the hoist line and connecting its lower end to the upper end of the tether for suspending and supporting said tether, said sling forming the portion of the hoist line which slidably passes through said slip means and is selectively engaged thereby, and said sling formed of material having sufficient strength to arrest vertical movement of the platform to permit lock-off operations and having cross sectional area and elongation characteristics to minimize elasticity under tension loads.

20. The method according to claim 18 in which the step of applying constant tension to the tether through the hoist line comprises;

connecting weight means to the hoist line which is connected to the upper end of the tethers, and selectively suspending said weight means on said hoist line to apply a nominal, motion-compensated, constant tension load on the tethers through the hoist line while said platform arrester moves with the platform during dynamic vertical motions of the platform.

* * * * *